US009275562B2

(12) United States Patent
Bazos

(10) Patent No.: US 9,275,562 B2
(45) Date of Patent: Mar. 1, 2016

(54) ADVERTISING APPARATUS

(71) Applicant: H. Christopher Bazos, Pickering (CA)

(72) Inventor: H. Christopher Bazos, Pickering (CA)

( * ) Notice: Subject to any disclaimer, the term of this patent is extended or adjusted under 35 U.S.C. 154(b) by 0 days.

(21) Appl. No.: 13/669,132

(22) Filed: Nov. 5, 2012

(65) Prior Publication Data

US 2013/0111791 A1 May 9, 2013

Related U.S. Application Data

(60) Provisional application No. 61/555,636, filed on Nov. 4, 2011.

(51) Int. Cl.

| | |
|---|---|
| ***G09F 13/00*** | (2006.01) |
| ***G09F 13/18*** | (2006.01) |
| ***G09F 27/00*** | (2006.01) |
| *G09F 13/26* | (2006.01) |
| *G09F 13/04* | (2006.01) |

(52) U.S. Cl.

CPC ..... *G09F 13/18* (2013.01); *G09F 27/005* (2013.01); *G09F 13/00* (2013.01); *G09F 13/04* (2013.01); *G09F 13/26* (2013.01); *G09F 2013/1831* (2013.01); *G09F 2013/1845* (2013.01); *G09F 2027/001* (2013.01)

(58) Field of Classification Search

CPC ..... G09F 13/04; G09F 13/00; G09F 13/26
USPC ..... 40/493–507, 544, 446, 546, 564, 451, 40/541, 575, 576
See application file for complete search history.

(56) References Cited

U.S. PATENT DOCUMENTS

| | | | | |
|---|---|---|---|---|
| 3,447,253 | A * | 6/1969 | Coad | 40/552 |
| 5,315,495 | A * | 5/1994 | Buser | 362/373 |
| 5,950,340 | A * | 9/1999 | Woo | 40/564 |
| 6,167,648 | B1 * | 1/2001 | Dimmick | 40/564 |
| 7,350,327 | B1 * | 4/2008 | Logan et al. | 40/570 |
| 7,400,228 | B2 * | 7/2008 | Abeyta | G08B 7/068 116/63 P |
| 7,827,714 | B2 * | 11/2010 | Howard | F21V 21/116 174/493 |
| 8,130,099 | B2 * | 3/2012 | Steinel et al. | 340/541 |
| 8,398,270 | B2 * | 3/2013 | Hermanson et al. | 362/276 |
| 8,646,194 | B2 * | 2/2014 | Podd | 40/578 |
| 2007/0204496 | A1 * | 9/2007 | Ellerton | 40/564 |
| 2009/0100727 | A1 * | 4/2009 | Chen | 40/546 |
| 2011/0277360 | A1 * | 11/2011 | Osiecki et al. | 40/541 |

* cited by examiner

*Primary Examiner* — Syed A Islam

(74) *Attorney, Agent, or Firm* — F. Brent Nix, Esq.; Johnson, Marcou & Isaacs, LLC

(57) ABSTRACT

Disclosed is an advertising apparatus capable of motion sensitive illumination and 180° viewing, which includes a top piece, a bottom piece, a back piece, one or more front side pieces capable of edge illumination, wherein the top piece, the bottom piece the back piece and the one or more front side pieces are mechanically coupled together to form the assembled advertising apparatus, and a universal mounting system base plate reversibly coupled to the back piece. In addition, an advertising apparatus capable of motion sensitive illumination and 180° viewing includes an illumination source for illuminating the front side pieces, a motion sensor, for detecting motion of a potential customer, and a power source to power the advertising apparatus, wherein the illumination source and the motion sensor are coupled to the power source.

21 Claims, 18 Drawing Sheets

ADVERTISING APPARATUS

CROSS REFERENCE TO RELATED APPLICATION

This application claims the benefit of the earlier fling date of U.S. Provisional Patent Application No. 61/555,636, filed Nov. 4, 2011, which is hereby incorporated herein by reference in its entirety.

FIELD OF THE INVENTION

The present disclosure relates generally to an apparatus for an advertisement. More specifically, the advertisement is motion sensitive and activates when a potential customer approaches.

BACKGROUND OF THE INVENTION

The broad field of retail advertising has gone through many changes from the time of posting a printed flyer inside a store window to the contemporary development of elaborate displays that are situated in the middle of a store's floor space that are designed to stimulate interest and promote unplanned purchases of the product. Retail advertising is geared to drive customers to consummate the purchase and/or is placed at the point of purchase to assure that the chosen product is kept foremost in the consumer's mind. This medium relies on a mixture of media delivered both outside and inside the retail environment. Examples of media that are delivered inside the retail environment are: paper posters placed in the windows of stores, examples of products on sale placed in the windows of stores, elaborate point-of-purchase displays that stand in the middle of stores' floor space, highlighting the promoted product. It is a goal of advertisers to make their products clearly visible to potential customers and to attract the attention of the potential customers. This is difficult to do, especially in a retail environment where potential customers are bombarded by advertisements and images of products all around them.

Thus, it would be advantageous to create an advertising system which draws the attention of a potential consumer, is cost effective, energy conscious and draws the attention of the potential customer. This advantage is met by the present disclosure.

SUMMARY OF THE DISCLOSURE

According to one embodiment, an advertising apparatus capable of motion sensitive illumination and 180° viewing includes a top piece, a bottom piece, a back piece, one or more front side pieces capable of edge illumination, and a universal mounting system base plate reversibly coupled to the back piece, wherein the pieces are mechanically coupled together to form the assembled advertising apparatus. In addition, an advertising apparatus capable of motion sensitive illumination and 180° viewing includes an illumination source for illuminating the front side pieces, a motion sensor, for detecting motion of a potential customer, and a power source to power the advertising apparatus, wherein the illumination source and the motion sensor are coupled to the power source.

In certain embodiments, the advertising apparatus includes two front side pieces, and a leading edge piece separating the two front pieces. In other embodiments, the advertising apparatus includes a single front side piece that is formed as an arc.

In certain embodiments, the advertising apparatus includes a battery compartment.

In certain embodiments, the advertising apparatus includes a motion detector housing positioned on the bottom piece, which is mechanically coupled to the motion detector.

In certain embodiments, the advertising apparatus includes a cam locking mechanism to lock the universal mounting system reversibly coupled to the back piece.

In certain embodiments, the advertising apparatus includes a power switch coupled to the power source, to power the advertising apparatus up or down.

In certain embodiments, the advertising apparatus includes a battery compartment cover.

In certain embodiments, the advertising apparatus includes the universal mounting system base plate and back piece configured to hide a battery compartment and power switch when locked in place.

In certain embodiments, the advertising apparatus includes a charging and/or AC/DC adaptor plug, for charging, and/or powering the advertising apparatus.

In certain embodiments, the illumination source is a set of light emitting diodes (LED).

In certain embodiments, the advertising apparatus includes an LED controller coupled to the power supply and the LEDs.

In certain embodiments, the LEDs are present in one or more LED strips.

In certain embodiments, the advertising apparatus includes a circuit board comprising a circuit, wherein the illumination source the motion sensor and the LED controller and the power source are coupled to the circuit.

In certain embodiments, the illumination source is an electroluminescence (EL) light source. In some examples, the electroluminescence (EL) light source is one or more of the font side pieces or mechanically coupled to the one or more of the font side pieces.

In certain embodiments, the advertising apparatus includes an EL controller coupled to the power supply and the EL.

In certain embodiments, the advertising apparatus includes a circuit board comprising a circuit, wherein the illumination source the motion sensor and the EL controller and the power source are coupled to the circuit.

In certain embodiments, the circuit is configured to operate as an on and forced off circuit.

The foregoing and advantages of the present disclosure will become more apparent from the following detailed description of a several embodiments, which proceeds with reference to the accompanying drawings.

Figure 1:
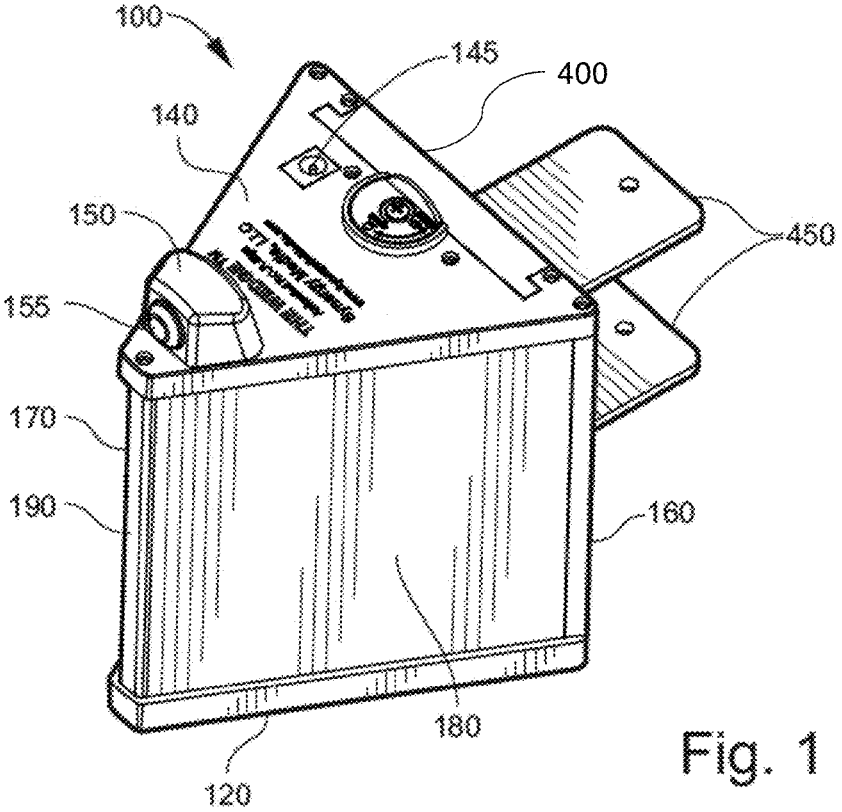
FIG. 1 is a perspective view of an exemplary embodiment of an advertising apparatus looking down at the bottom of the apparatus.

All illustrations of the drawings are for the purpose of describing selected versions of the present invention and are not intended to limit the scope of the present invention.

DETAILED DESCRIPTION

The singular terms "a," "an," and "the" include plural referents unless context clearly indicates otherwise. Similarly, the word "or" is intended to include "and" unless the context clearly indicates otherwise. The term "comprises" means "includes." In case of conflict, the present specification, including explanations of any terms, will control.

The present disclosure concerns embodiments of an advertising apparatus for dispensing material. The disclosed embodiments are particularly suited for capturing the attention of a potential customer. This is done through a motion sensor that detects the movement of an approaching potential customer and causes the display to light up when the potential customer draws near, thus drawing the attention of the customer at the appropriate time, while being programmed to conserve power usage, for example prolonging battery life. Using one or more universal mounting systems the advertising apparatus has the advantage of being mountable to a horizontal or vertical surface, for example using a clamp, magnets, or suction cups and the like. In addition, when mounted, the advertising apparatus has the further advantage of or providing a display surface(s) that are viewable from multiple angles, such from a 180°. By way of example a potential customer walking either direction down a super market aisle would be able to view the graphics present on the sides of the apparatus and particularly when illuminated. In addition a potential customer would be able to view the graphics when looking directly at the advertising apparatus. Thus, one of the many advantages of the disclosed advertising apparatus is that it has a 180° viewing angle.

The disclosed advertising apparatus uses electronic means to generate interest in the graphically displayed advertising present on the display surfaces of the advertising apparatus. This is accomplished by illuminating the advertising graphics in a way such that an approaching potential customer sees the illuminated advertising graphic and can be drawn to it. Rather than having a sign that is constantly lit or flashes at intervals at a constant rate, which tends to be either lost in the milieu of other sights and sounds or in the case of a constantly flashing sign, somewhat annoying, the disclosed apparatus relies instead on proximity of a potential customer to trigger illumination and the advertising apparatus and advertising graphics, and thus draw the attention to the apparatus and it accompanying graphics. In essence the light appears out of nowhere when the potential customer is not expecting it and has the effect of grabbing a person's attention which in psychological terms is the called the reticular activating system, e.g. when a person sees something happening in your environment and proceeds to investigate. However, rather than being a simple on off switch activated by proximity, the advertising apparatus disclosed herein includes sophisticated circuitry designed both to attract attention and rest, thereby prolonging battery life of the stand-alone apparatus. No tools are required for installation, which means that it is easy for employees to install & service a battery door in the back of the display. The location of the battery door makes theft of batteries difficult.

One of the many advantages of the disclosed advertising apparatus is that it has the ability to be re-used on a continual basis, e.g. it is not viewed as a single use, single product advertising apparatus. Because both the graphics, and the power supply, in the case of batteries, have the ability to be changed out, the disclosed advertising device has an environmental advantage compared to other conventional point of sale static and lighted signs in the market place. This ability to alter the advertising apparatus's display graphics further provides an advantage to the retailer in lowering costs.

FIG. 1 shows an exemplary advertising apparatus 100 according to one embodiment. With reference to FIG. 1, advertising apparatus 100 includes top piece 120, bottom piece 140 (which includes charging and/or AC/DC adaptor plug 145, motion sensor housing 150, and motion sensor 155), back piece 160, front side 170 and front side 180 and leading edge 190. In this view, front side 170 is occluded from view. Cam locking 300 is also shown attached to top piece 140, for example attached with a fastener. This view also shows universal mounting system 400 slotted into back piece 160 and clamp mount 450 protruding from the universal mounting system 400. With reference to FIG. 1, bottom 140 is shown, and motion sensor housing 150 is clearly visible protruding from the surface of bottom 140. In this view, the individual pieces of apparatus 100, such as top piece 120, bottom piece 140, and leading edge 190 are shown fastened together using small screws, however it is contemplated that additional fastener or even adhesives could be used to attach the individual pieces together in the assembled apparatus. Front side 170 and front side 180 are the principle places for graphics to be places and are configured to be surface illuminated, for example that can be lit with light emitting diodes (LEDs) or an electroluminescence (EL) light source and the like, such that the surface of front side 170 and front side 180 give off light, glow or appear illuminated. This, in turn, illuminates a graphic, such as graphics depicting a particular product or service. For example, an advertisement for a product or service, placed on the surface of front side 170 and front side 180 are illuminated for a potential customer. It is contemplated that the graphics would be inter changeable, for example as thin sheet of printed plastic and the like placed on the surface of front side 170 and front side 180; however, it is also contemplated that the graphics could be directly placed in the surface of front side 170 and front side 180, for example printed. As detailed below, the timing of this illumination has advantages for customer attraction and/or energy savings. The advertising graphics can be replaced easily by sliding precut sheets of material into small channels between top piece 120, bottom piece 140 and front sides 170 and 180. The graphics can be the same or different. While reference is given to the top and bottom of the advertising apparatus, it is contemplated that the advertising apparatus can be installed upside down and still function, for example as installed on a low shelf, such that motion sensor housing 150, and motion sensor 155 on in the top, relative to the earth, of the apparatus. In such a case, the graphics orientation can be reversed.

The top piece, back piece, bottom piece and leading edge can be made of any material, however plastic, such as thermomoldable plastic is preferred. The front side pieces are typically made of a substantially clear material, such that when the material is edge lit, light passes through the material. In some embodiments, the front sides are light guides, by light guide it is meant that when the material is edge lit, the light is guided across the material and can be further guided to illuminate that face of the material in a uniform manner or substantially uniform manner. In some embodiments, this is done using a piece of plastic that has been printed so that it has spots on it that disperse the light to the face of the material. Alternatively, such edge-lens technology uses small bumps and/or indentations that guide the light to the surface of the material and illuminate the display surfaces. Essentially, this technology pulls the light across the plane evenly. For example, for a 4×4 piece of acrylic and with only one edge lit printing and/or etching pulls the light evenly across the acrylic back lighting the piece. In some embodiments, the light or illumination source is electroluminescence (EL). EL is an optical phenomenon and electrical phenomenon in which a material emits light in response to the passage of an electric current or to a strong electric field. Examples of the range of EL materials include thin-film zinc sulfide doped with manganese and semiconductors containing Group III and Group V elements, such as indium phosphide (InP), gallium arsenide (GaAs), and gallium nitride (GaN). Typically the EL material is a thin film, which can be mechanically couple to a backer, such as a plastic backer, for example the front sides of the disclosed advertising apparatus. Electroluminescent technologies have low power consumption, and are thus well suited to the use in the disclosed advertising apparatus.

With further reference to FIG. 1, motion sensor housing 150 is shown protruding from bottom piece 140 with motion sensor 155 mounted. Sensor housing 150 can be positioned anywhere on the outer surface of bottom piece 140. As is shown in FIG. 1, in certain embodiments, sensor housing 150 is positioned slightly recessed from the front edge of bottom piece 140. This provides several advantages; one of which is to prevent or decrease the probability that a potential customer's interaction with the apparatus (such as bumping the apparatus) does not damage the lens portion of motion sensor 155 mounted in sensor housing 150. Another advantage of positioning sensor housing 150 in this manner is that limits the effective range of motion sensor 155, allowing for tuning the apparatus to capture the movement of a potential customer at an optimal range for viewing the apparatus when it is triggered. For example positioning sensor housing 150 recessed from the edge limits the range of motion sensor 155 from the furthest extent, for example 30 feet or greater, to about 10 feet, thus the range of the device can be tuned. In addition, the front facet of sensor housing 150 can be angled, such that mounted motion sensor 155 can be directed to the most likely place a customer will travel. This allows the assembled apparatus to be able to be mounted low or high, for example placed on a lower shelf or a higher shelf. This can be accomplished by placing the housing on a single side (top or bottom) and reversing the orientation of the apparatus, for example with a reversible bracket. For example, by tilting the front surface of sensor housing 150, the mounted motion sensor can be angled either up or down.

Typically motion sensor 155 is an infrared sensor, such as a passive infrared sensor, although other motion sensors are contemplated for use in the apparatus. In specific embodiments, the motion sensor is an infrared sensor, such as a multifaceted infrared sensor. Passive infrared sensor sensors allow sensing of motion, by detecting changes in levels of infrared radiation. In some examples, the sensor in a motion detector splits in one or more facets which can be used to detect a change in motion. In certain embodiments, the multifaceted lens detects the presence of an approaching customer, such as by detecting the body heat of such customer, and as the customer's heat moves across, two, three or even four facets of the lens, it triggers the apparatus. This has the advantage of limiting the interaction to actual potential customers and it also limits it only triggering when the potential customer is actually within range and able to see the display and what's going on with the display. For example, if a customer were to walk part way into the field of the sensors vision, and then reverse course, the sensor would not activate and battery power would be saved, rather than activating for a customer who is now facing the opposite direction.

While a particular shape of the advertising device is shown in FIG. 1, a variety of shapes are contemplated. In one such set of embodiments, the general wedge shape as shown in FIG. 1 is maintained. However, the angle between the illuminated surfaces (with reference to FIG. 1, front side 170 and front side 180) is changed, for example in any degree, or partial degree increment, from about 0° to about 180°, such as about 0°, 1°, 2°, 3°, 4°, 5°, 6°, 7°, 8°, 9°, 10°, 15°, 20°, 25°, 30°, 35°, 40°, 45°, 50°, 55°, 60°, 65°, 70°, 75°, 80°, 85°, 90°, 95°, 100°, 120°, 150° or 180°, such as about 10° to about 150°, about 20° to about 100°, and about 30° to about 90° and the like. In the 180° configuration, the advertising apparatus would appear as flat, while in the 0° configuration the advertising device would appear as a blade.

Figure 2:
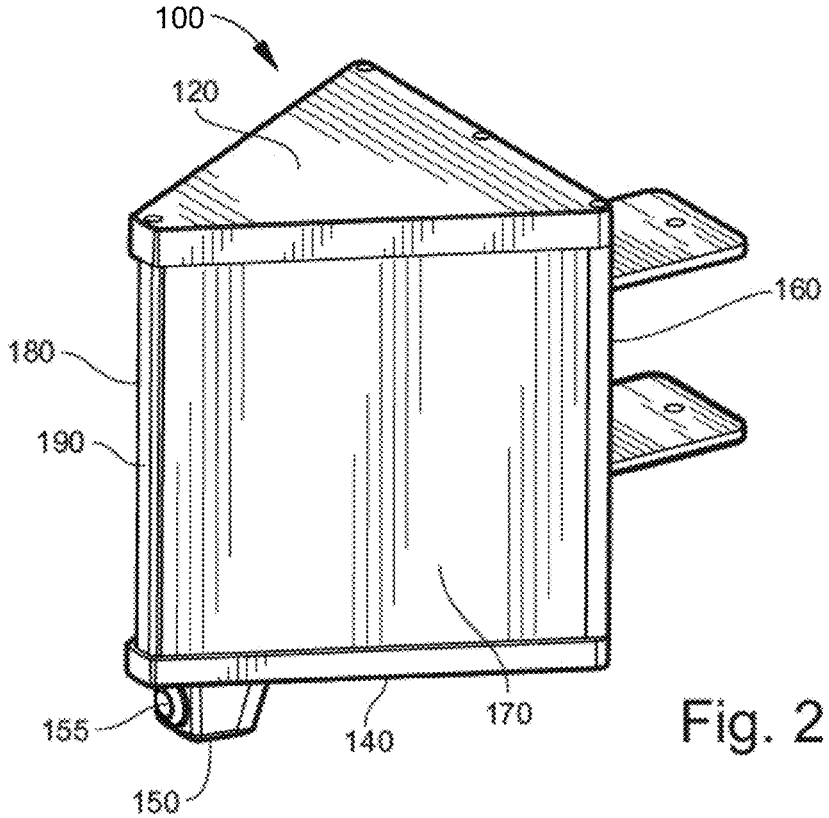
FIG. 2 is a perspective view of the advertising apparatus shown in FIG. 1, rotated 180°.

FIG. 2 shows advertising apparatus 100 as depicted in FIG. 1 rotated about the horizontal such that top piece 120 and front side 170, leading edge 190 are in view, with back piece 160 and bottom piece 140 occluded from view. With reference to FIG. 2, motion sensor housing 150 is clearly visible protruding from the surface of bottom 140.

Figure 3:
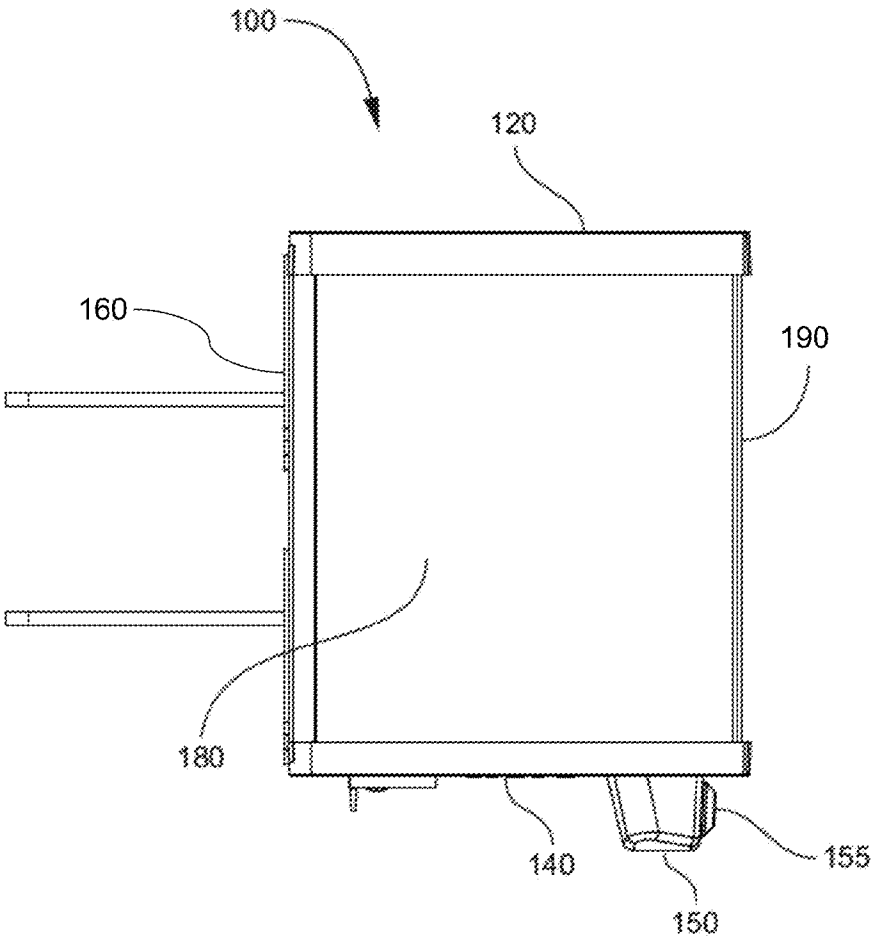
FIG. 3 is side elevation view of the advertising apparatus shown in FIG. 1.

FIG. 3 shows a side elevation view of advertising apparatus 100. Front side 180 is shown bounded by top piece 120 and bottom piece 140, back piece 160 and leading edge 190. Bottom 140 includes motion sensor housing 150 and motion sensor 155. In this view, the angle of the front edge of motion sensor housing 150 can be seen deviating from vertical, which aims motion sensor 155.

Figure 4:
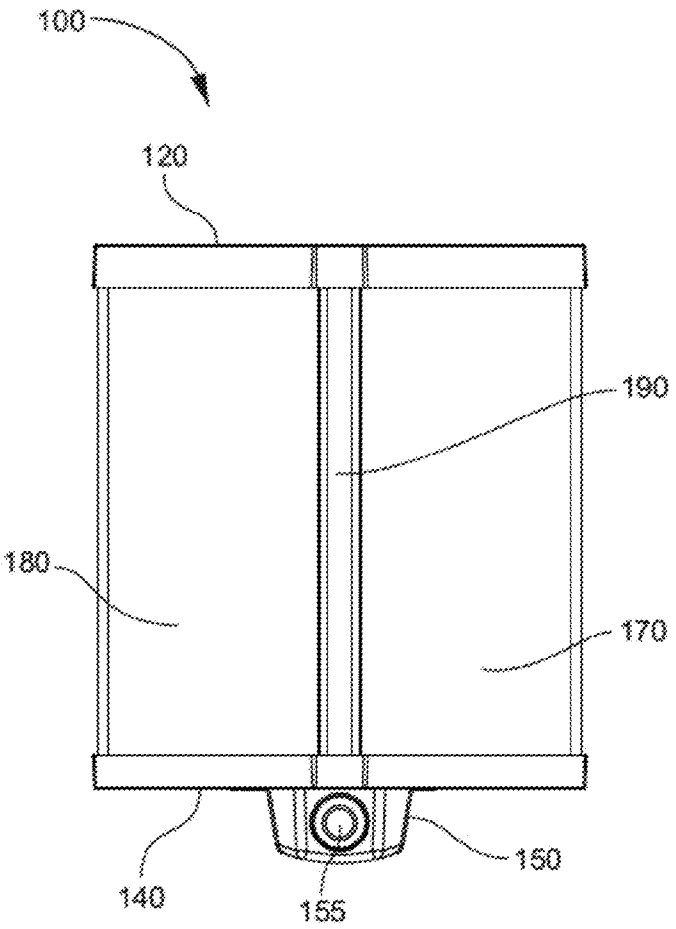
FIG. 4 is a front elevation view of the advertising apparatus shown in FIG. 1.

FIG. 3 shows a front on elevation view of advertising apparatus 100. With reference to FIG. 4, leading edge 190 separates front side 170 from front side 180. Front sides 170 and 180 are bounded on the top and bottom by top 120 and bottom 140. Bottom 140 includes motion sensor housing 150 and motion sensor 155.

Figure 6:
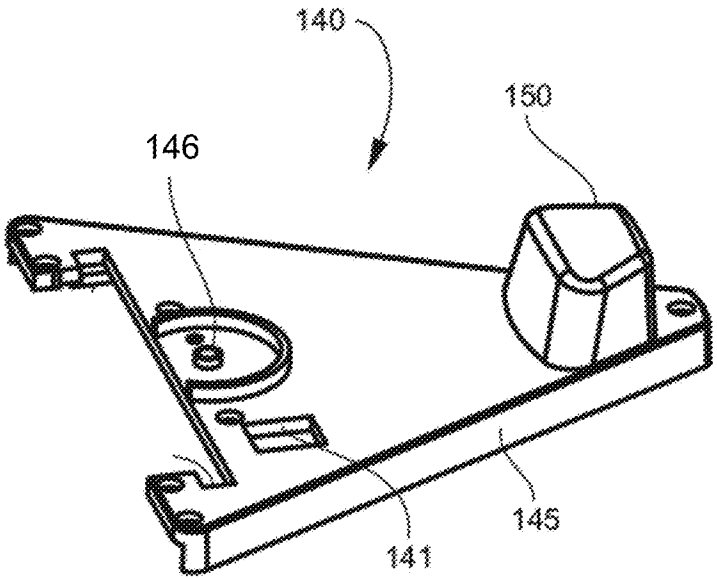
FIG. 6 is a perspective view of the bottom piece of the advertising apparatus shown in FIG. 1, showing the external face of the bottom piece relative to the assembled apparatus.
Figure 5:
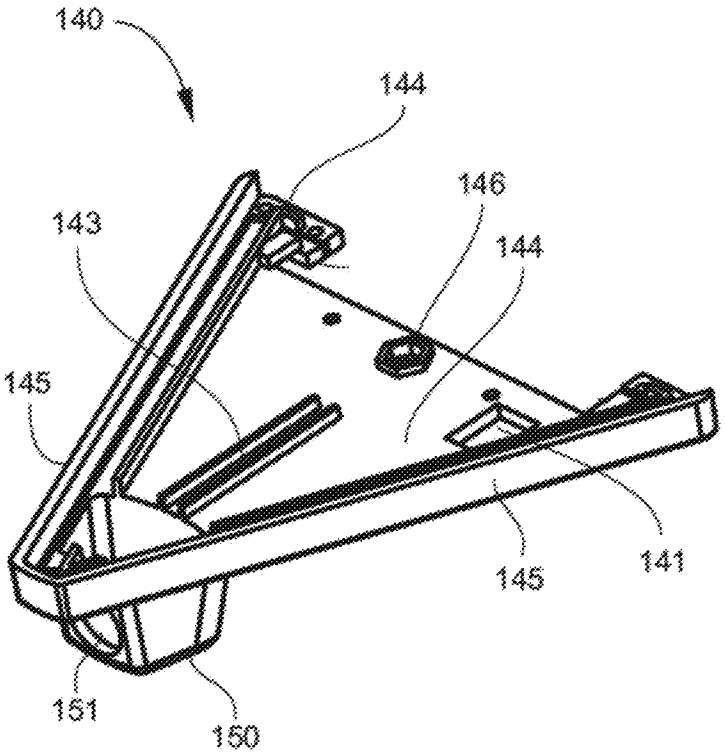
FIG. 5 is a perspective view of the bottom piece of the advertising apparatus shown in FIG. 1, showing the internal face of the bottom piece relative to the assembled apparatus.

The bottom piece of the advertising apparatus is best shown by FIGS. 5 and 6. FIG. 5 shows the internal face of bottom piece 140, with respect to the assembled apparatus. With reference to FIG. 5, bottom piece 140 includes inner channels 144 bounded by sides 145 into which front side 170 and front side 180 (see e.g., FIG. 1) seat in the assembled apparatus. In the assembled apparatus, the replaceable graphics slide into channel 144, between front side 170 and front side 180 and sides 145 and are held in place, for example by friction. In addition, in the final assembled advertising apparatus, a lighting system to provide edge lighting, such as an LED light system can be nested into channel 144. Also shown is the charging and/or AC/DC adaptor plug mounting hole 141 with charging and/or AC/DC adaptor plug removed, and wire guide 143, cam locking mechanism mounting hole 146, motion sensor housing 150, mounting hole 151 for the motion sensor (not shown). The location of charging and/or AC/DC charging and/or AC/DC adaptor plug mounting hole 141 can be placed as desired, including the top piece or back piece. FIG. 6 shows bottom piece 140 rotated 180° relative to FIG. 5. With reference to FIG. 6, side 145 is shown as cam locking mechanism mounting hole 146, and charging and/or AC/DC adaptor plug mounting hole 141.

Figure 7:
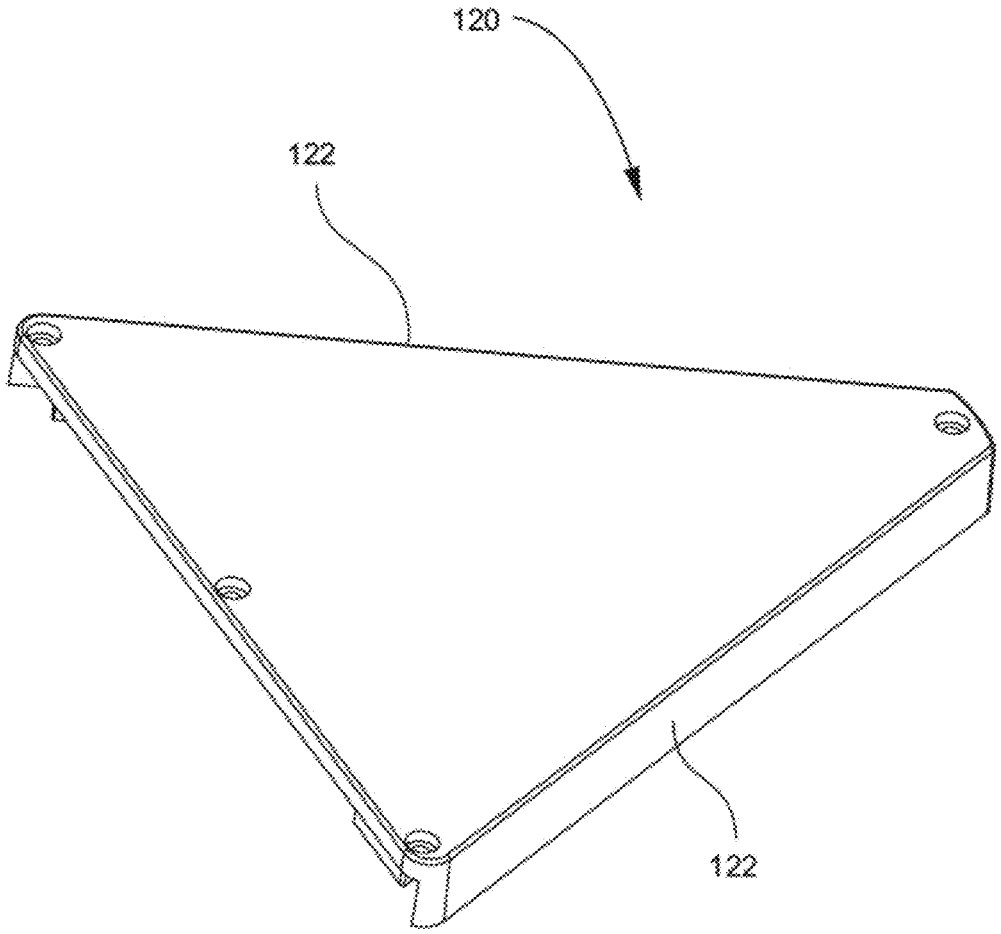
FIG. 7 is a perspective view of the top piece of the advertising apparatus shown in FIG. 1, showing the external face of the top piece relative to the assembled apparatus.
Figure 8:
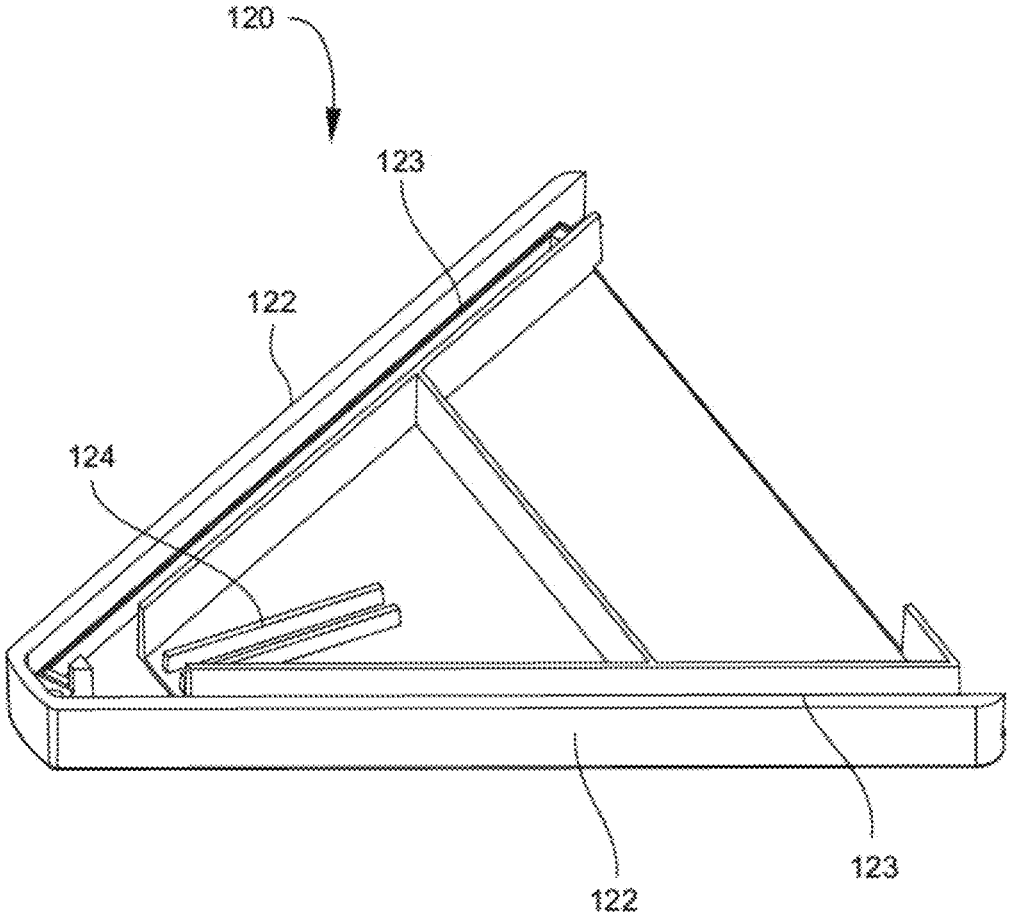
FIG. 8 is a perspective view of the top piece of the advertising apparatus shown in FIG. 1, showing the internal face of the top piece relative to the assembled apparatus.

The top piece of the advertising apparatus is best shown by FIGS. 7 and 8. FIG. 7 shows the external surface, with edges 122 that bound the front sides in the assembled apparatus. FIG. 8 shows top piece 120 rotated 180° relative to FIG. 7. The depiction shows internal features of the top piece and includes sides 122 and channels 123 which front side 170 and front side 180 (see e.g., FIG. 1) seat in the assembled apparatus. In the assembled apparatus, the replaceable graphics slide into channel 123 between front side 170 and front side 180 and sides 122 and are held in place, for example by friction. In addition in the final assembled advertising apparatus, a lighting system to provide edge lighting, such as an LED light system can be nested into channel 123. Alternatively, the lighting system can be nested into the grooves of the bottom piece shown in FIGS. 5 and 6. Also shown is optional wire guide 124 as well as internal bracing.

Figure 9:
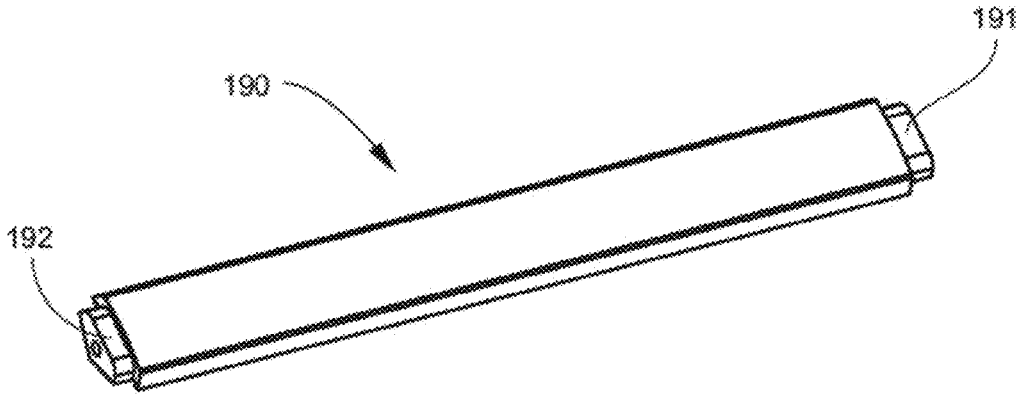
FIG. 9 is a perspective view of a leading edge (front edge) of the advertising apparatus shown in FIG. 1, showing the external face of the leading edge relative to the assembled apparatus.
Figure 10:
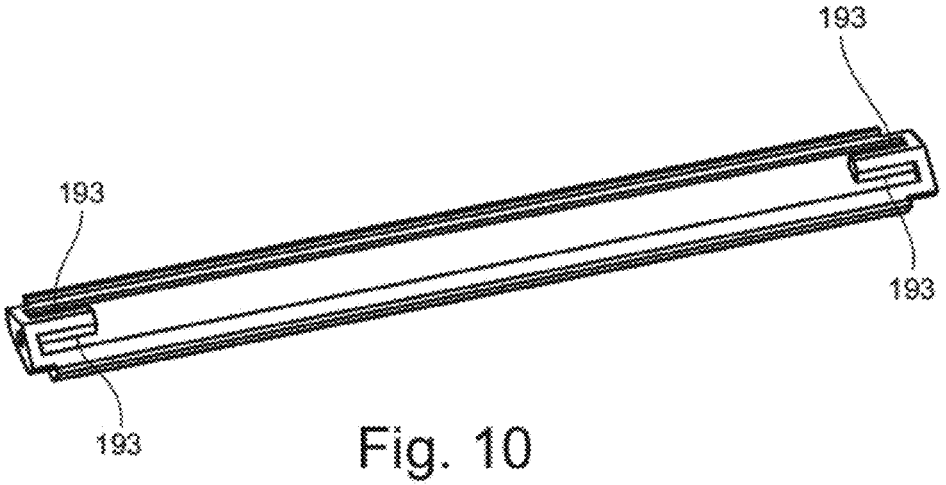
FIG. 10 is a perspective view of the leading edge of the advertising apparatus shown in FIG. 1, showing the internal face of the leading edge relative to the assembled apparatus.

The front edge of the advertising apparatus is best shown by FIGS. 9 and 10. FIGS. 9 and 10 show the front edge 190 disassembled from the apparatus. With reference to FIG. 9, front edge 191 includes tabs 192, which slot into the top piece and bottom piece in the assembled apparatus. FIG. 10 shows front edge 190 rotated 180° relative to FIG. 9. In this view, slots 193 can be seen, into which the front edges slot in the assembled apparatus. In some embodiments, the leading edge of the advertising apparatus is extended so that the graphic would slide under a slight extension/lip so it would fill the frame completely and there was no distracting light being emitted anywhere except through the graphic.

Figure 11:
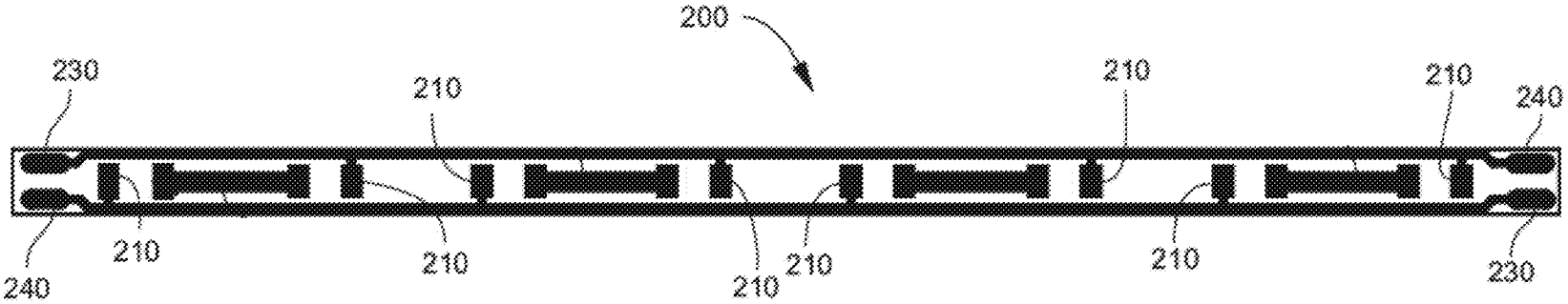
FIG. 11 is a view of a LED mounting assembly for the advertising apparatus shown in FIG. 1.
Figure 12:
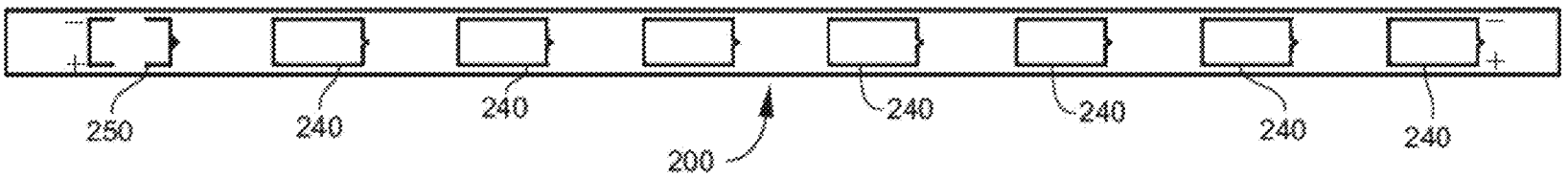
FIG. 12 is a view of the LED mounting assembly for the advertising apparatus shown in FIG. 1.

FIGS. 11 and 12 show a LED housing assembly that can be slotted into the channels in the top and bottom pieces of the apparatus. Alternatively, they can be slotted into grooves in the back piece or front edge. With reference to FIG. 11, LED assembly 200 includes circuitry with LED attachment points 210 and positive and negative terminals 230 and 240 respectively. FIG. 12 shows the LED housing assembly 200 rotated along the long axis. The assembly includes LED attachment positions 240. In this embodiments, 8 LED attachment points are shown; however, it is contemplated that more or fewer could be used, for, example 1, 2, 3, 4, 5, 6, 7, 8, 9, 10, 11, 12, 13, 14, 15, 16 or more depending on the application. Eight LED attachment points, however, are preferred for power consumption and lighting.

Figure 14:
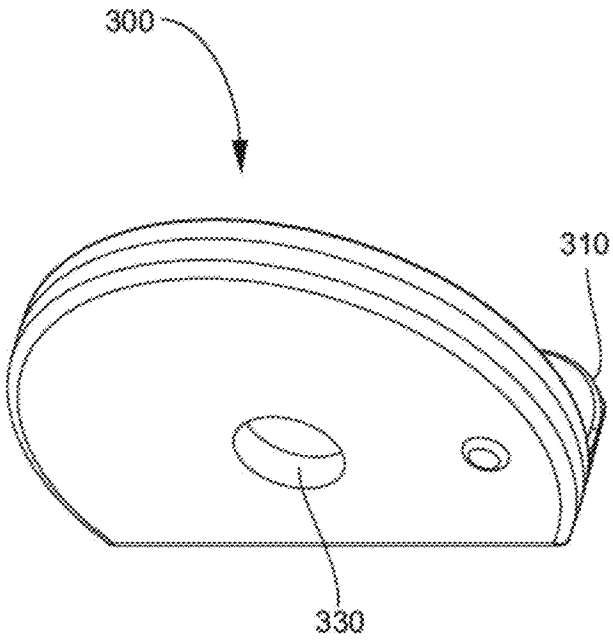
FIG. 14 is perspective bottom view of a cam locking mechanism of the advertising apparatus shown in FIG. 1.
Figure 13:
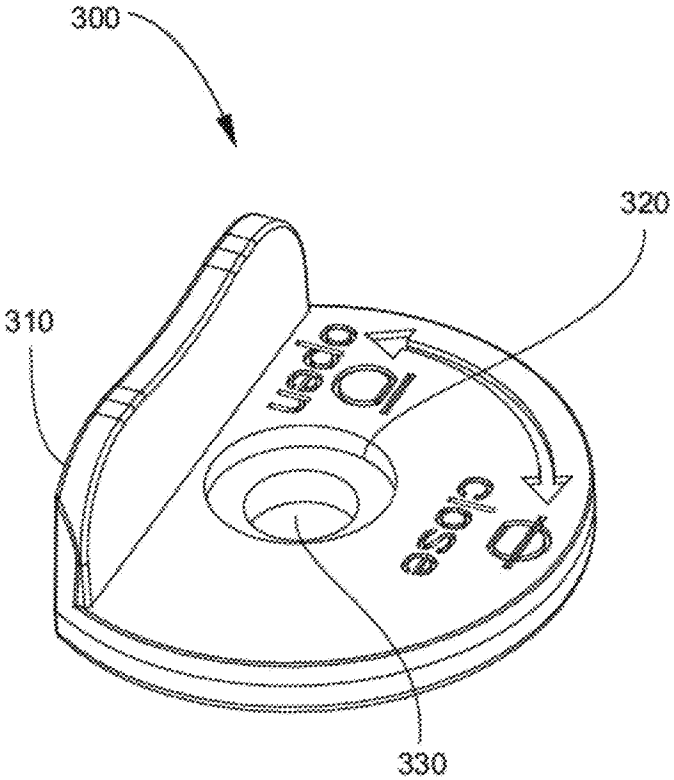
FIG. 13 is perspective top view of a cam locking mechanism of the advertising apparatus shown in FIG. 1.

FIGS. 13 and 14 show the universal mounting system cam locking mechanism. In the open position, the universal mount system is free to slide up and down the slots in the back side of the apparatus. With reference to FIG. 13, cam locking mechanism 300 includes flat portion 305 that sits against bottom piece of the apparatus. Cam locking mechanism 300 also includes a raised portion 310 for turning cam locking mechanism 300, hole 330 for a fastener attaching the cam locking mechanism 300 the bottom piece of the apparatus and inset 320 so that a fastener can be seated substantially flush with the top surface of cam locking mechanism 300.

Figure 15:
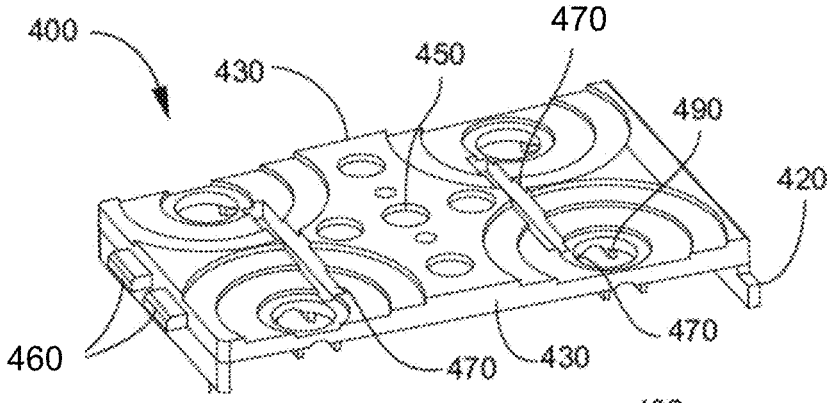
FIG. 15 is perspective view of a universal mounting system base plate for the advertising apparatus shown in FIG. 1, showing the external face of the universal mounting system base plate relative to the assembled apparatus.
Figure 16:
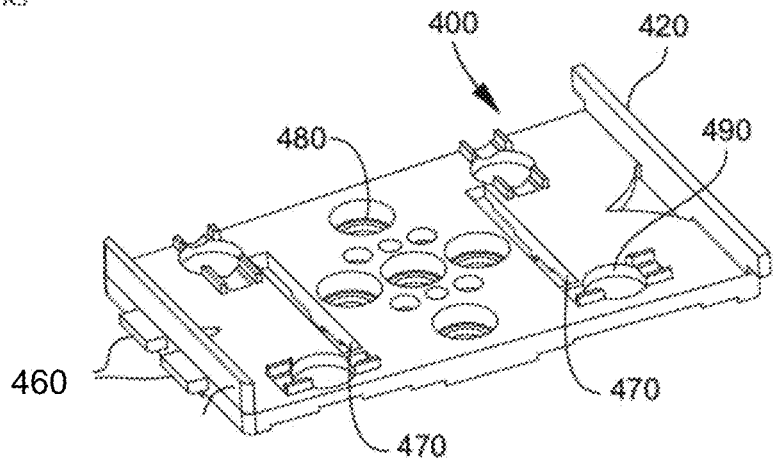
FIG. 16 is perspective view of a universal mounting system base plate for the advertising apparatus shown in FIG. 1, showing the internal face of the universal mounting system base plate relative to the assembled apparatus.

The universal mounting system base plate is best shown in FIGS. 15 and 16. With reference to FIG. 15, which shows the outer face of universal mounting system base plate 400 relative to the assembled apparatus, universal mounting system base plate 400 includes seeding tabs 420, sides 430, mounting holes 440, guide tabs 460, clamp mounting slots 470 and suction cup mounting holes 490. Universal mounting system base plate 400 includes several features to mount additional optional mounting hardware. Mounting holes 450 can be used to mount additional hardware using fasteners for placement of the assembled apparatus, including as clamp, for example clamp mount 450 shown in FIG. 1. Clamp mount 450 shown in FIG. 1 can be guided though clamp mounting slots 470 and attached with fasteners to universal mounting system base plate 400 using fatteners to mounting holes 440. In addition, suction cups can be mounted to suction cup mounting holes 490. Guide tabs 460 and seeding tabs 420 position universal mounting system base plate 400 within the channel on the back piece of the advertising apparatus.

The universal mounting system addresses several challenges present in an advertising environment. First is mounting, given the diversity in mounting situations, such as different size shelving, a universal mounting system was developed that provides the ability to customize the apparatus to a variety of situations likely to be encountered. As a solution, the inventors devised a universal mounting system that includes a universal mounting system base plate that slips into a slot on the back of the advertising apparatus and locks in place, using the universal mounting system cam locking mechanism. The universal mounting system is configured to accommodate a variety of mounting hardware. In one embodiment, the universal mounting system includes a clamp that can be finger tightened for placement on a horizontal shelf and attaches to the universal mounting system base plate. In another embodiment, the universal mounting system includes a magnetic attachment that attaches to the universal mounting system base plate. In another embodiment, the universal mounting system includes one or more suction cups that attaches to the universal mounting system base plate. In addition, to combat tampering with the apparatus and battery theft, when the universal mounting system base plate is in place, such as locked in place with the cam locking mechanism, both the on/off switch and the battery compartment are occluded for view and hence deter tampering. This deters persons from either tampering with the apparatus or stealing battery from the apparatus in a surveillance environment, such as a store. The clamp mounting hardware is typically a C-shaped steel bracket. For suction cup mounting, between about 1 and about 16 suction cups can be used, such as 1, 2, 3, 4, 5, 6, 7, 8, 9, 10, 11, 12, 13, 14, 15, or 16 suction cups, depending on the application.

In some embodiments, the sides of the universal mounting base plate are substantially non-parallel, such that the universal mounting base plate fits securely in the channel of the back piece of the advertising apparatus. One advantage of using the substantially non-parallel sides of the universal mounting system base plate is that it allows the universal mounting system base plate to slide it up and down and lock in place with a simple cam lock, with all of the weight supported at the top and on the sides, so there's no one area of the universal mounting system base plate that is bearing an unreasonable amount of weight.

Figure 17:
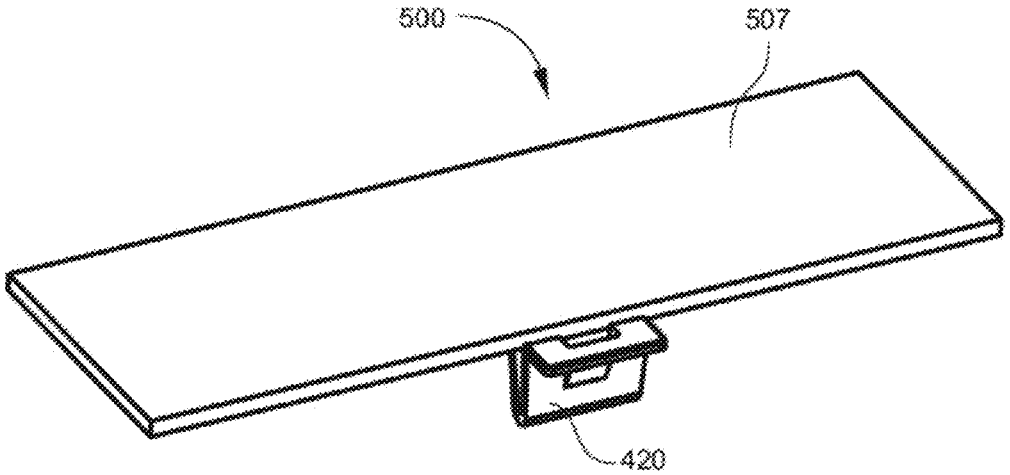
FIG. 17 is perspective view of a battery compartment cover for the advertising apparatus shown in FIG. 1, showing the external face of the battery compartment cover relative to the assembled apparatus.
Figure 18:
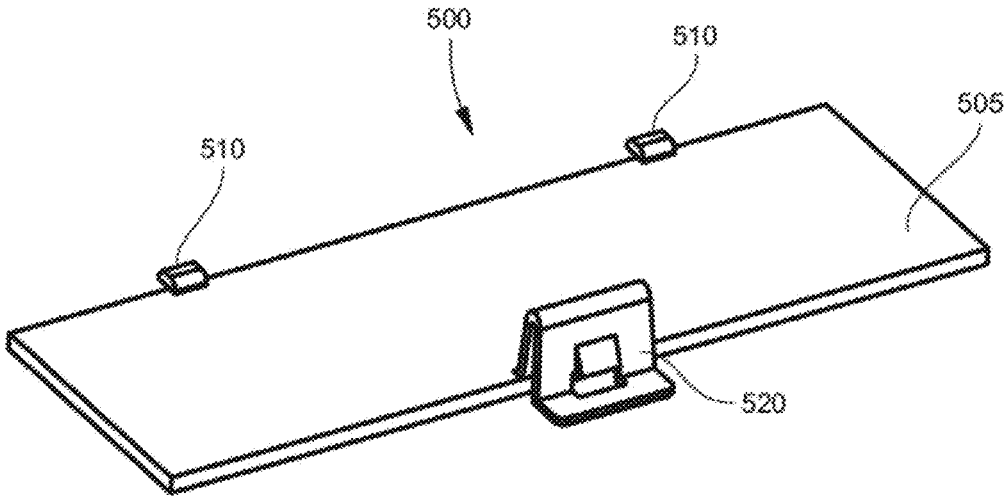
FIG. 18 is perspective view of a battery compartment cover for the advertising apparatus shown in FIG. 1, showing the internal face of the battery compartment cover relative to the assembled apparatus.

FIGS. 17 and 18 show the battery compartment cover. With reference to FIGS. 17 and 18, battery compartment cover 500 includes inner face 505, outer face 507, location tabs 510 and snap lock 520. Location tabs 510 slide into recesses in the back piece to locate battery cover 500 with respect to the back piece. Snap lock 520 snaps into place in a recess in the back piece and can be actuated by hand.

Figure 19:
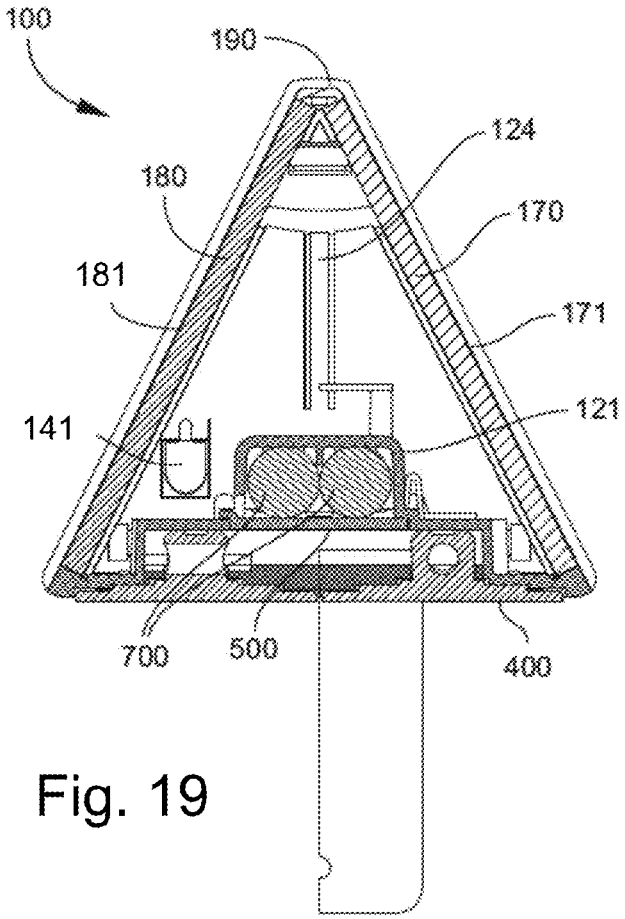
FIG. 19 is a top down sectional view of the advertising apparatus shown in FIG. 1.
Figure 20:
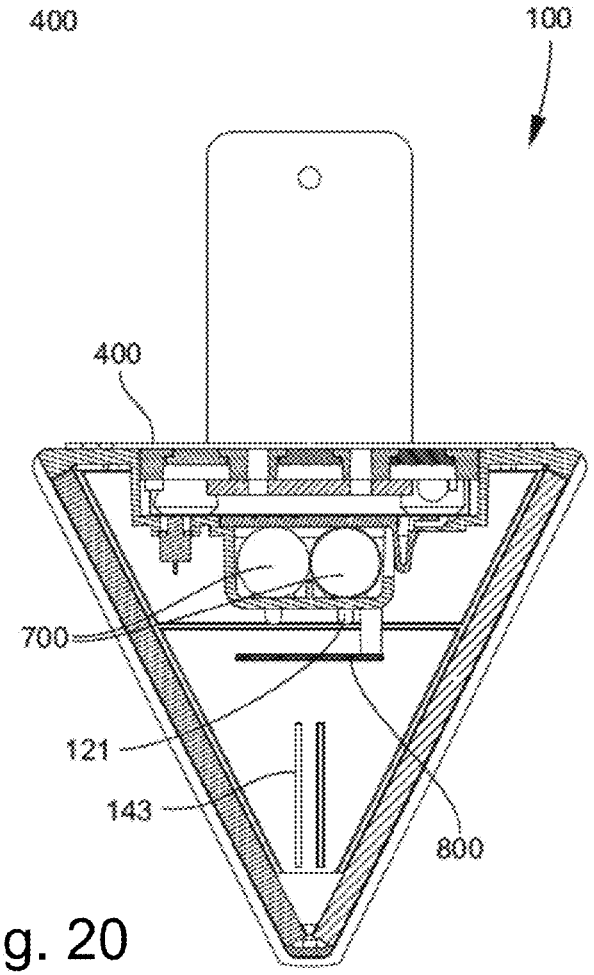
FIG. 20 is a bottom up sectional view of the advertising apparatus shown in FIG. 1.

The internal structure of the assembled apparatus is best shown in FIGS. 19 and 20. With reference to FIG. 19, a top down sectional view, advertising apparatus 100 includes, battery compartment wall 121, wire guide 124, charging and/or AC adaptor mounting hole 141, back piece 160, front side 170 with front surface 171, front side 180 with front surface 181, and leading edge 190. Also shown is universal mounting system 400, battery compartment cover 500, batteries 700 and circuit board 800. Battery compartment wall 121 is connected to back piece 160 and forms a compartment when battery compartment cover 500 is in place, securing batteries 700. In this view, front surfaces 171 and 181 of front sides 170 and 180 are shown and are where the graphics are positioned. Circuit board 800, which controls the electronic aspects of advertising apparatus 100, is shown attached to battery compartment wall 121 for convenience. It is contemplated that circuit board 800 can be attached to any convenient surface within the assembled advertising apparatus. With reference to FIG. 20, a bottom up sectional view, advertising apparatus 100 includes, battery compartment wall 121, wire guide 143, universal mounting system base plate 400, batteries 700 and circuit board 800. Battery compartment wall 121 is connected to back piece 160 and forms a compartment when battery compartment cover 500 is in place, securing batteries 700. In this view, front surfaces 171 and 181 of front sides 170 and 180 are shown and are where the graphics are positioned.

Figure 21:
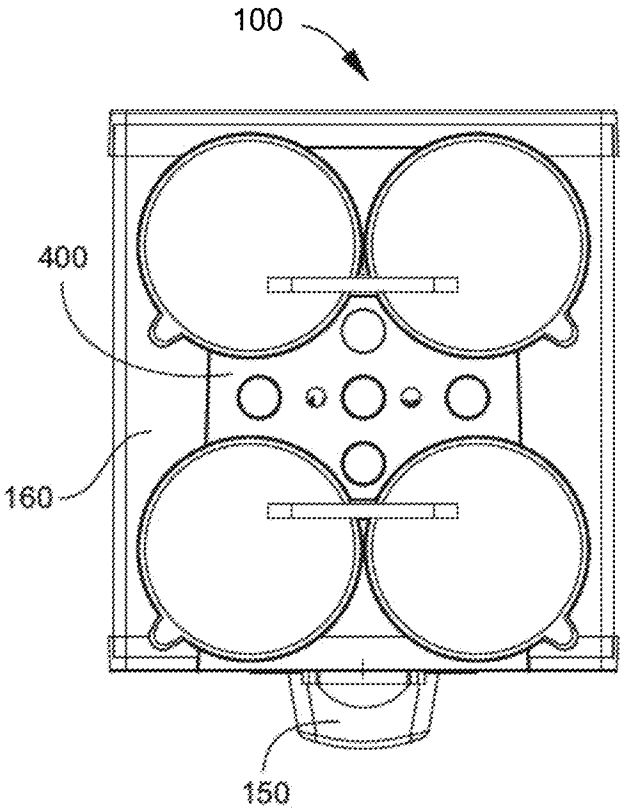
FIG. 21 is a back elevation view of the advertising apparatus shown in FIG. 1.

FIG. 21 is a rear view of the advertising apparatus 100, showing back piece 160, with universal mounting system base plate 400 installed. Also shown is a superposition of the clamp bracket and the suction cups as mounted in universal mounting system base plate 400. This view also shows the substantially non-parallel sides of universal mounting system base plate 400.

Figure 22:
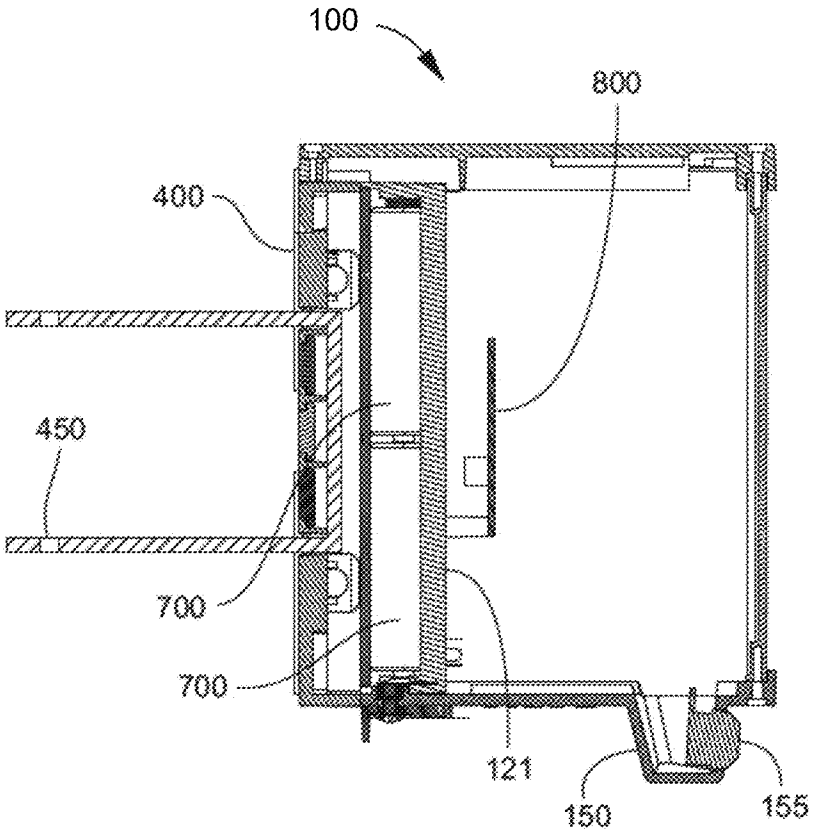
FIG. 22 is a side sectional view the advertising apparatus shown in FIG. 1.

FIG. 22 is a side view cut away of assembled advertising apparatus 100. In this view, compartment wall 121 is visible as is motion sensor housing 150, with motion sensor 155 installed. Also shown are universal mounting plate 400, with mounting clamp guide 450 installed, batteries 700 and circuit board 800.

Figure 23A:
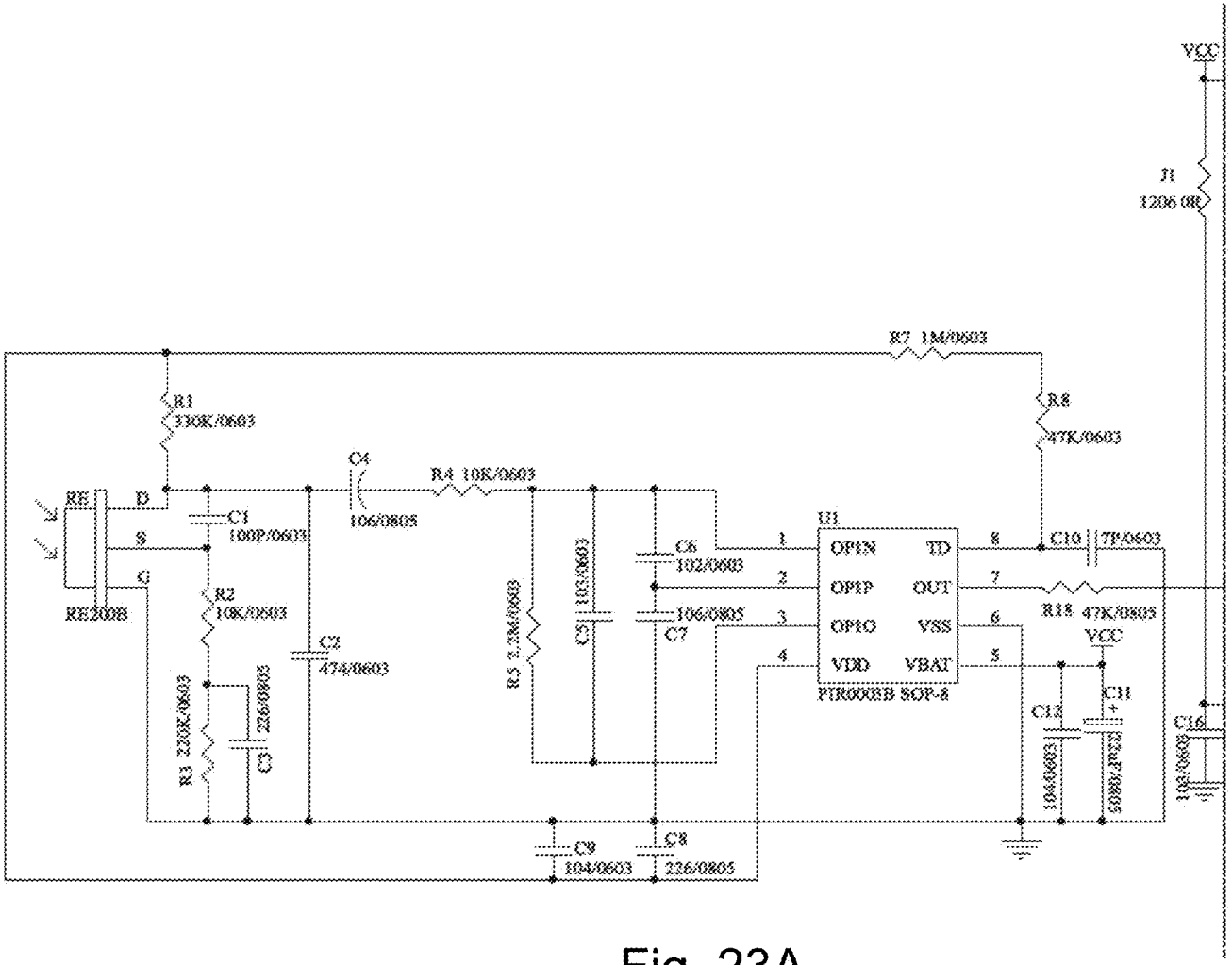
FIGS. 23A-23C is a circuit diagram of an exemplary circuit for controlling the advertising apparatus shown in FIG. 1.
Figure 23B:
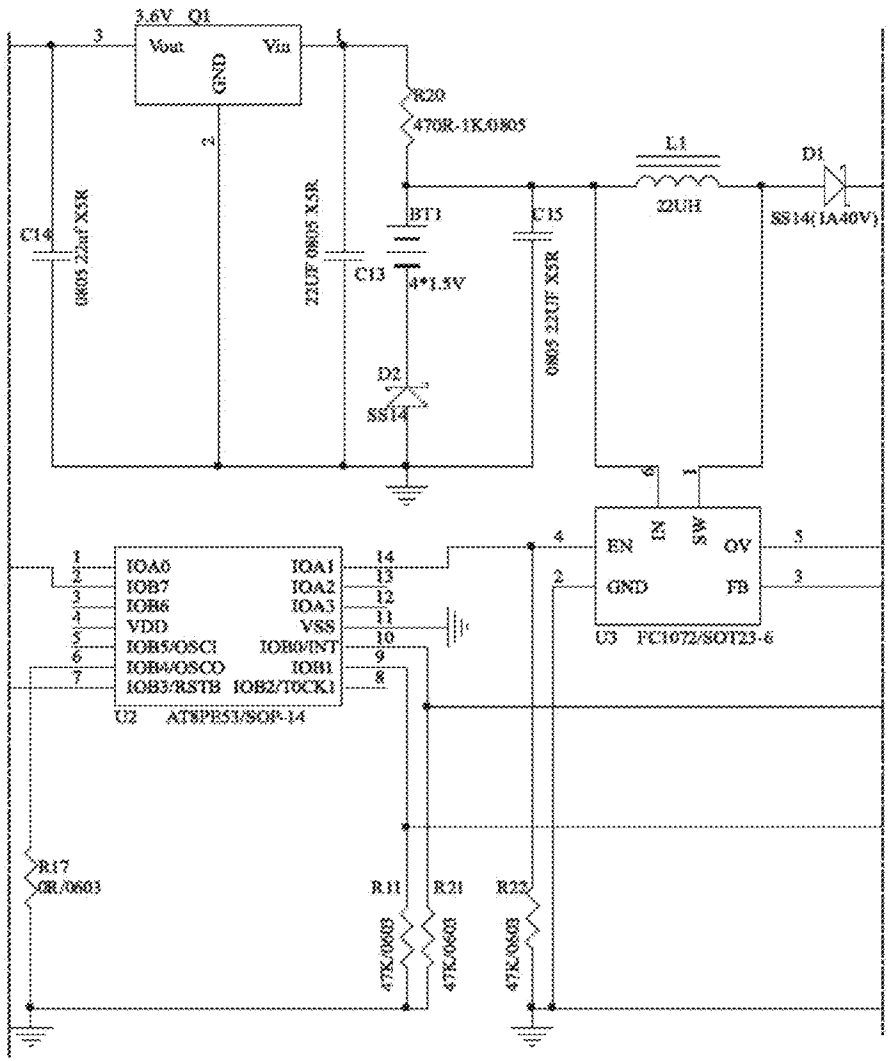
Figure 23C:
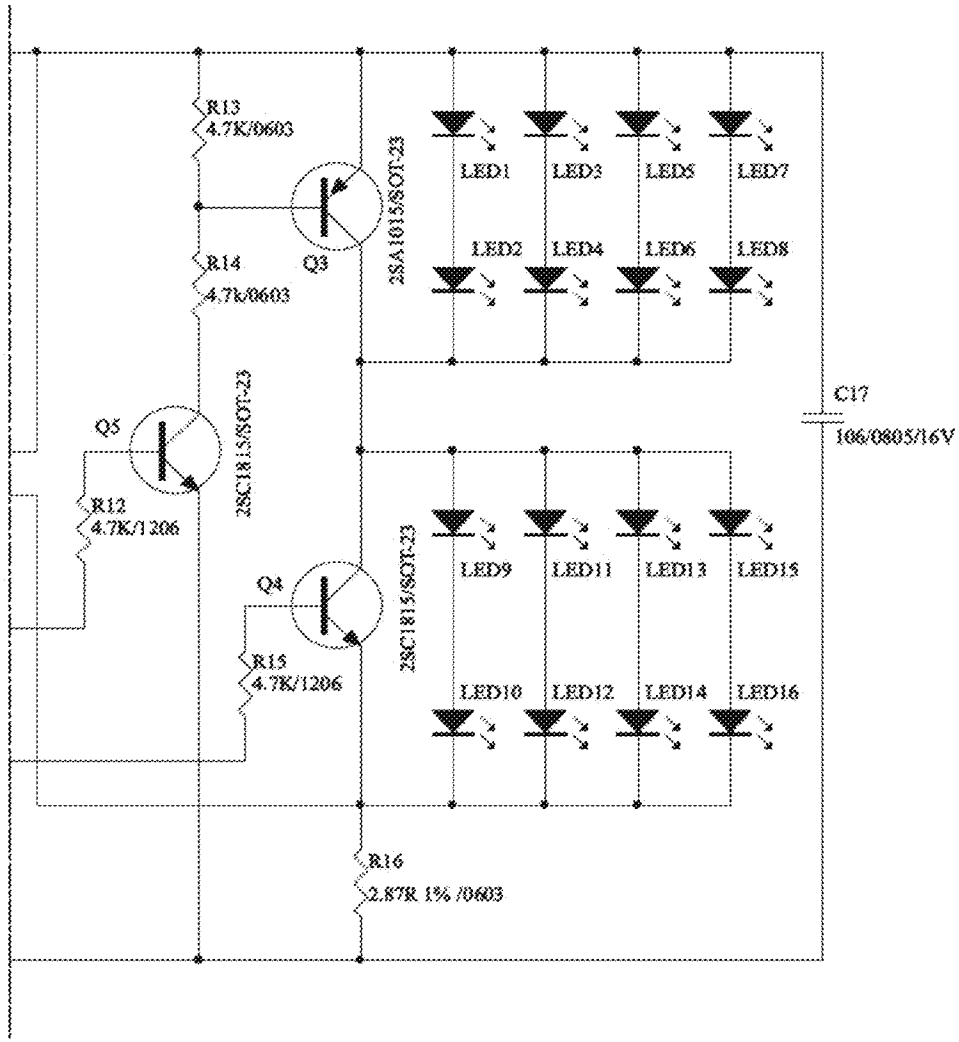

FIG. 23A-23C is an exemplary circuit for controlling the electronics of the advertising apparatus. The circuit is designed to operate the advertising apparatus for about 30 days, for example using pulse modulation. Specific technologies known to those of ordinary skill in the art including those disclosed herein are applied which are then used to bring the current drain down to an acceptable level so that the apparatus can function in a location, such as in a store, for the 30-day programs without battery changes. In some embodiments, the circuit includes LEDs and an LED controller. The LED controller can be configured to further reduce the current drain and to control the light. In some embodiments, the LEDs are controlled such that they do not light at the full battery power available to them, for example, they light at a fraction of the full power available for a short duration of time, for example as a pulse, which provides a rest period for the batteries. So that in turn extends battery life considerably. In some embodiments, the circuit includes EL material and optionally a controller for the EL material. The controller for the EL material can be configured to further reduce the current drain and to control the light. In some embodiments, the EL material is controlled such that they do not light at the full battery power available to them, for example, they light at a fraction of the full power available for a short duration of time, for example as a pulse, which provides a rest period for the batteries. So that in turn extends battery life considerably.

The circuit also includes a passive infrared sensor. The passive infrared sensor allows the advertising device to be interactive with the potential customer and to remain static when the potential customer is not there. In this application, it becomes an interactivity that limits battery drain and at the same time assures that the longevity of the product in the intended application. And as a potential customer approaches the passive infrared sensor will trigger so that the advertising apparatus is within the potential customer's peripheral vision at that point. By incorporating the passive infrared sensor, this limits the exposure of the lighting to the passive infrared sensor who's walking by rather than just flashing indiscriminately (such as an LED that's flashing on the end of the aisle). In some embodiment, the circuit, includes one or more LED strips, such as 1, 2, 3, 4, 5, 6, 7, 8, 9, 10, 11, 12, 13, 14, 15, or 16 strips, which can include between about 1 and 32 LEDs each, such as 1, 2, 3, 4, 6, 7, 8, 9, 10, 11, 12, 13, 14, 15, 16, 17, 18, 19 20, 21, 22, 23, 24, 25, 26, 27, 28, 29, 30, 31 or 32, LEDs. In one embodiment, there are two LED strips of 8 LED's apiece coupled to an LED driver, coupled to a passive infrared circuit, which then controls the on/off function, coupled to a power source, such as a DC or AC power source, for example batteries. In some embodiments, there is also a DC or AC input charging port, for example, for running the advertising device on DC input, rather than batteries, which if available would be a cost savings. In some examples, which when the DC or AC input charging port is plugged in internal power supply from the batteries is superseded. In other embodiment, rechargeable batteries are used (for example, Nickel-Cadmium (Ni-Cad), Lithium Ion (Li-ion) and Nickel-Metal-Hydride (Ni-MH)) and plugging in a charger or AC adapter recharges the batteries.

In some embodiments, the circuit is configured to operate as on and forced off circuit. This means that the advertising device is active for a period of time and then inactive for a period of time before becoming active again in a cyclic fashion. The forced rest is designed for two things; one is to keep battery power which will reduce the amount of battery power required, the second is to reduce the possibility of someone triggering the advertising apparatus for amusement, for example a child who waves their hands in front of it, it won't automatically trigger on and off, on and off, on and off, and will eventually tire of the game an move one. In some embodiments, the circuit is configured for a on period of about 1 second to about 120 seconds or longer, such as about 1, 2, 3, 4, 5, 6, 7, 8, 9, 10, 12, 15, 20, 25, 30, 35, 40, 45, 50, 55, 60, 70, 80, 90, or 120 seconds, for example between about 1 and 10, 5 and 20, or 5 and 8 seconds. In some embodiments, the rest period configured to be from about 1 second to about 2 minutes or longer, such as about 1, 2, 3, 4, 5, 6, 7, 8, 9, 10, 12, 15, 20, 25, 30, 35, 40, 45, 50, 55, 60, 70, 80, 90, or 120 seconds, for example between about 10 and 10, 15 and 25, or 5 and 10 and 40 seconds. In a particular example, the circuit is configured to have about 7 seconds of on and 20 seconds of off time (also called 7/20), as this was determined to be optimal for battery life and to also improve the attraction mode, or the attractor mode.

In some embodiments, the LED controller is configured such that during the on time the after triggering the LED is continuously lit, alternating LED strips are lit (flashing one and then the other), flashing simultaneously. In some embodiments, the LEDs are lit sequentially such that it appears that the illuminated surfaces of the advertising apparatus light from one side across the illuminated surface. In some embodiments, the LEDs would operate sequentially, or even non-sequentially to create a ripple effect or strobe effect. In some embodiments, the EL controller is configured such that during the on time the after triggering the EL is continuously lit, alternating EL pieces are lit (flashing one and then the other), flashing simultaneously. In some embodiments, the EL strips are lit sequentially such that it appears that the illuminated surfaces of the advertising apparatus light from one side across the illuminated surface. In some embodiments, the EL material would operate sequentially, or even non-sequentially to create a ripple effect or strobe effect.

In some embodiments, the LED controller is configured such the LEDs are not turned on in a burst, but rather fade on, for example to a fraction of total battery power before turning off, such as with pulse modulation. In some embodiments, the LEDs fade up to about 10% to about 90% of battery power, such as about 10%, 20%, 30%, 40%, 50%, 60%, 70%, 80%, or 90%. In some embodiments, the EL controller is configured such the EL materials are not turned on in a burst, but rather fade on, for example to a fraction of total battery power before turning off, such as with pulse modulation. In some embodiments, the EL material fade up to about 10% to about 90% of battery power, such as about 10%, 20%, 30%, 40%, 50%, 60%, 70%, 80%, or 90%.

Figure 24:
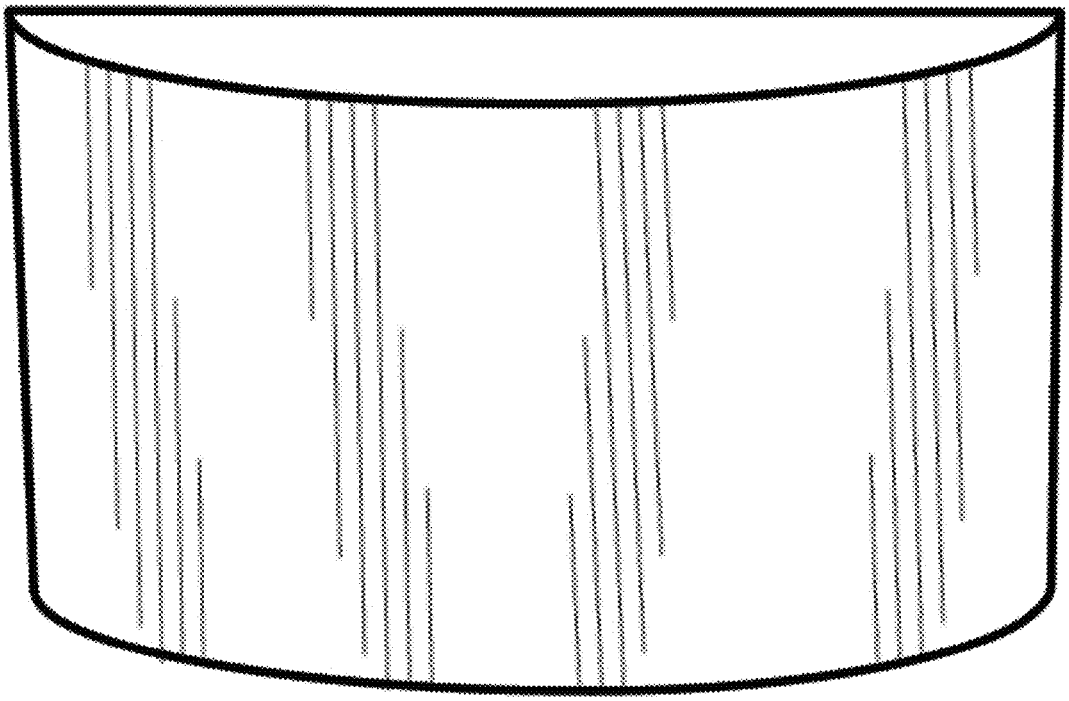
FIG. 24 is a perspective view of an alternate embodiment of an advertising apparatus.

FIG. 24 is a perspective view of an alternate embodiment of the advertising apparatus, in which the graphic display surface is an arc or ellipse. In this embodiment, the front side is a single surface and there is no leading edge. The advertising apparatus can be supported by one of more, such as a two universal mounting system.

Figure 25:
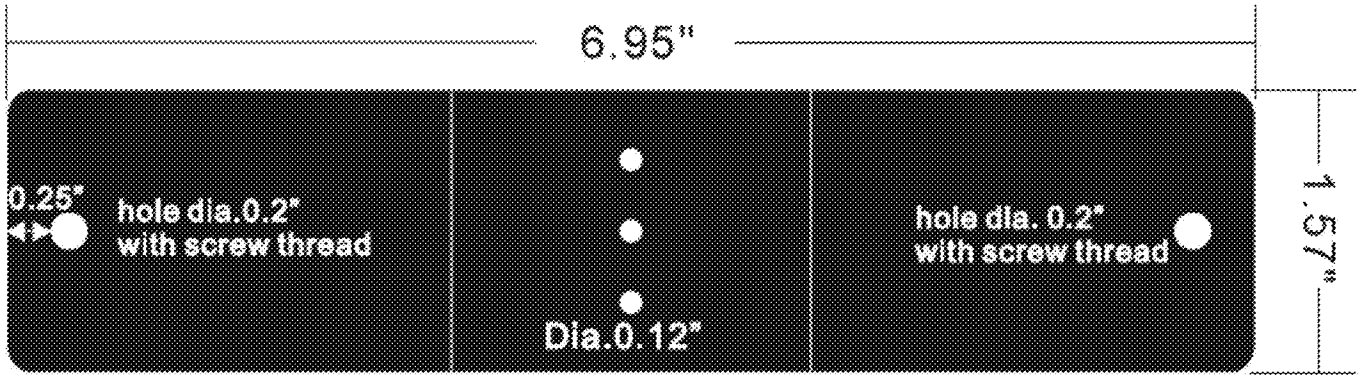
FIG. 25 is a flattened view of a C-shaped clamp of the advertising apparatus shown in FIG. 1.

FIG. 25 is a flattened view of a C-shaped clamp of the advertising apparatus shown in FIG. 1.

Figure 26:
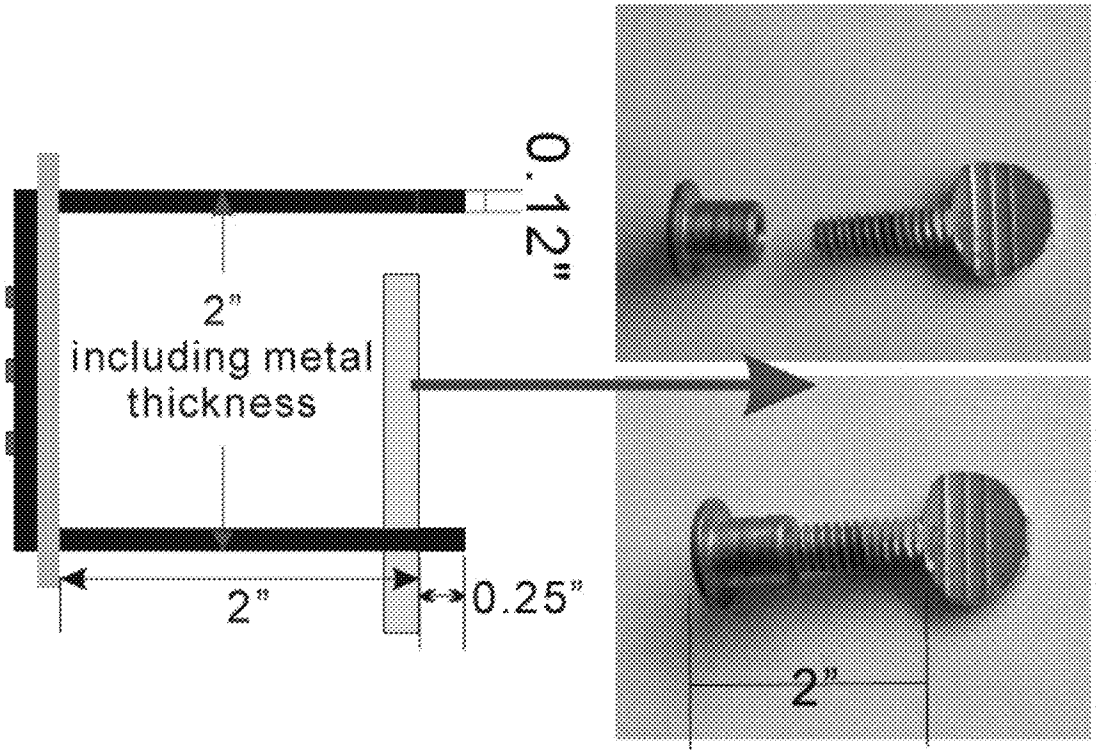
FIG. 26 is a right-side view of the C-shaped clamp with a pair of digital images photographs of a mounting screw.

FIG. 26 is a right-side view of the C-shaped clamp with a pair of digital images photographs of a mounting screw. A non-slip coating on the mounting clamp helps keep the display in the desired position. A "foot" on the mounting screw eliminates damage to a shelf caused by a mounting screw without the foot.

In view of the many possible embodiments to which the principles of our invention may be applied, it should be recognized that illustrated embodiments are only examples of the invention and should not be considered a limitation on the scope of the invention. Rather, the scope of the invention is defined by the following claims. We therefore claim as our invention all that comes within the scope and spirit of these claims.

I claim:

1. An advertising apparatus capable of motion sensitive illumination and 180° viewing, the apparatus comprising:

a top piece;

a bottom piece;

a back piece, comprising a single trapezoidal shape channel for reversible coupling to a universal mounting system base plate wherein the channel comprises substantially non-parallel sides;

one or more front side display surface pieces to display graphics present on the one or more front side pieces, wherein the top piece, the bottom piece, the back piece and the one or more front side display surface pieces are mechanically coupled together to form the assembled advertising apparatus;

an illumination source for illuminating the front side display surface pieces wherein the one or more front side display surface pieces are edge illuminated when the illumination source is active to display graphics present on the one or more front side pieces;

a multifaceted motion sensor, for detecting motion of a potential customer, wherein the multifaceted motion sensor is configured to trigger the apparatus when a customer's heat moves across at least two facets of the multifaceted motion sensor;

a power source to power the advertising apparatus, wherein the illumination source and the motion sensor are coupled to the power source;

and the universal mounting system base plate reversibly coupled to the back piece, comprising guide tabs for positioning the universal mounting system base plate within the channel on the back piece and seeding tabs for positioning the universal mounting system base plate within the channel on the back piece, and substantially non-parallel sides slotting within the channel on the back piece of the advertising apparatus, such that the universal mounting base plate fits securely in the channel of the back piece of the advertising apparatus.

2. The advertising apparatus of claim 1, wherein the one or more front side pieces is two front side display surface pieces, and the advertising apparatus further comprises a leading edge piece separating the two front display surface pieces.

3. The advertising apparatus of claim 1, wherein the two front side display surface pieces are configured with an angle of between about 20° and about 100° between them.

4. The advertising apparatus of claim 1, wherein the two front side display surface pieces are configured with an angle of between about 40° and about 80° between them.

5. The advertising apparatus of claim 1, further comprising a battery compartment.

6. The advertising apparatus of claim 1, wherein the bottom piece further comprises a motion detector housing and wherein the motion detector is mechanically coupled to the motion detector housing.

7. The advertising apparatus of claim 1, further comprising a cam locking mechanism to lock the universal mounting system reversibly coupled to the back piece.

8. The advertising apparatus of claim 1, wherein the multifaceted motion sensor is a passive infrared motion sensor.

9. The advertising apparatus of claim 1, further comprising a power switch coupled to the power source to power the advertising apparatus up or down.

10. The advertising apparatus of claim 1, further comprising a battery compartment cover.

11. The advertising apparatus of claim 1, wherein the universal mounting system base plate and back piece are configured to hide a battery compartment and power switch when locked in place.

12. The advertising apparatus of claim 1, further comprising a charging and/or AC/DC adaptor plug, for charging, and/or powering the advertising apparatus.

13. The advertising apparatus of claim 1, wherein the illumination source is a set of light emitting diodes (LED) placed at the edge of the front side display surface pieces capable of edge illumination.

14. The advertising apparatus of claim 13, further comprising a controller for the illumination source coupled to the power supply and the illumination source.

15. The advertising apparatus of claim 13, wherein the LEDs are present in one or more LED strips.

16. The advertising apparatus of claim 15, wherein the advertising apparatus comprises two LED strips of 8 LEDs each.

17. The advertising apparatus of claim 14, further comprising a circuit board comprising a circuit, wherein the illumination source, the motion sensor, the controller for the illumination source and the power source are coupled to the circuit.

18. The advertising apparatus of claim 17, wherein the circuit is configured to operate as cycled on and forced off circuit, wherein the on period is from about 1 second to about 120 seconds and the off period is from about 1 second to about 120 seconds.

19. The advertising apparatus of claim 18, wherein the on period is about 7 seconds and about 20 seconds of off time.

20. The advertising apparatus of claim 1, wherein the one or more front side display surface pieces capable of edge illumination is a single front side display surface piece and the display surface is formed as an arc.

21. The advertising apparatus of claim 1, wherein the front side display surface comprise electroluminescent material.

* * * * *